US009771661B2

(12) United States Patent
Piascik et al.

(10) Patent No.: US 9,771,661 B2
(45) Date of Patent: Sep. 26, 2017

(54) METHODS FOR PRODUCING A HIGH TEMPERATURE OXIDATION RESISTANT MCRALX COATING ON SUPERALLOY SUBSTRATES

(75) Inventors: James Piascik, Randolph, NJ (US); Derek Raybould, Denville, NJ (US); Vincent Chung, Tempe, AZ (US); George Reimer, Simpsonville, SC (US); Lee Poandl, Middlesex, NJ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 1194 days.

(21) Appl. No.: 13/366,759

(22) Filed: Feb. 6, 2012

(65) Prior Publication Data

US 2013/0341197 A1 Dec. 26, 2013

(51) Int. Cl.

| | |
|---|---|
| ***C25D 5/50*** | (2006.01) |
| ***C23C 28/02*** | (2006.01) |
| ***C25D 5/12*** | (2006.01) |
| ***C25D 3/66*** | (2006.01) |
| ***C25D 5/14*** | (2006.01) |
| ***C25D 7/00*** | (2006.01) |

(52) U.S. Cl.

CPC ..... *C25D 5/50* (2013.01); *C23C 28/022* (2013.01); *C25D 5/12* (2013.01); *C25D 5/14* (2013.01); *C25D 7/00* (2013.01); *C25D 3/665* (2013.01)

(58) Field of Classification Search

CPC ... C23C 28/022; C23C 28/3215; C23C 4/073; C25D 5/50; C25D 3/04–3/12; C25D 3/66–3/665; C25D 3/44; C25D 5/40

See application file for complete search history.

(56) References Cited

U.S. PATENT DOCUMENTS 2,133,995 A * 10/1938 Lukens ..... C25D 3/48 205/170
2,299,054 A * 10/1942 Harshaw ..... C25D 5/40 205/180
2,457,061 A * 12/1948 McQuire ..... C25D 5/40 205/181
2,936,269 A * 5/1960 Gendvil ..... C25C 7/005 204/246

(Continued)

FOREIGN PATENT DOCUMENTS

CN 101914792 A 12/2010
CN 101994128 A 3/2011

(Continued)

OTHER PUBLICATIONS

Schaschke, Heat Treatment, A Dictionary of Chemical Engineering 180 (2014).*

(Continued)

*Primary Examiner* — James Lin
*Assistant Examiner* — Ho-Sung Chung
(74) *Attorney, Agent, or Firm* — Lorenz & Kopf, LLP

(57) ABSTRACT

Methods for producing a high temperature oxidation and hot corrosion resistant MCrAlX coating on a superalloy substrate include applying an M-metal, chromium, and aluminum or an aluminum alloy comprising a reactive element to at least one surface of the superalloy component by electroplating at electroplating conditions below 100° C. in a plating bath thereby forming a plated component and heat treating the plated component.

10 Claims, 1 Drawing Sheet

(56) References Cited

U.S. PATENT DOCUMENTS 3,129,149 A * 4/1964 Johnson ..... C25D 5/40 148/252
3,600,284 A * 8/1971 Martinez ..... C25C 7/06 205/367
3,607,413 A 9/1971 Buzzelli
3,634,207 A * 1/1972 Toledo ..... C25D 5/40 205/125
4,123,594 A * 10/1978 Chang ..... C23C 28/021 428/610
4,463,071 A 7/1984 Gifford et al.
4,747,916 A 5/1988 Kato et al.
4,789,441 A 12/1988 Foster et al.
4,801,363 A 1/1989 Gregory
4,810,334 A 3/1989 Honey et al.
4,849,060 A * 7/1989 Smit ..... C25D 3/44 205/372
4,904,355 A 2/1990 Takahashi
4,906,342 A 3/1990 Takahashi et al.
5,037,513 A 8/1991 Foster
5,074,973 A * 12/1991 Takahashi ..... C25D 3/44 205/234
5,681,661 A * 10/1997 Kelly ..... B01J 19/0093 181/286
5,743,013 A * 4/1998 Taylor ..... C23C 4/02 29/889.1
5,856,027 A 1/1999 Murphy
6,113,770 A 9/2000 Rasmussen
6,123,997 A 9/2000 Schaeffer et al.
6,221,181 B1 * 4/2001 Bossmann ..... C22C 1/0433 148/410
6,280,857 B1 * 8/2001 Sommer ..... C22C 1/0433 420/442
6,291,014 B1 9/2001 Warnes et al.
6,695,960 B1 2/2004 Bacos et al.
6,974,636 B2 12/2005 Darolia et al.
6,998,151 B2 2/2006 Grylls et al.
7,569,131 B2 8/2009 Hixon-Goldsmith et al.
7,939,205 B2 5/2011 Klaassen
7,989,020 B2 8/2011 Strangman et al.
8,354,189 B2 1/2013 Pham et al.
8,778,164 B2 7/2014 Piascik et al.
2001/0031375 A1 10/2001 Bugnet et al.
2001/0054557 A1 * 12/2001 Taylor ..... C25D 3/06 205/103
2002/0132132 A1 9/2002 Bose et al.
2003/0211239 A1 11/2003 Grylls et al.
2005/0064228 A1 3/2005 Darolia et al.
2007/0196670 A1 * 8/2007 Barshilia ..... C23C 14/568 428/446
2007/0227895 A1 * 10/2007 Bishop ..... C25D 3/06 205/287
2007/0275305 A1 11/2007 Omote
2008/0107805 A1 5/2008 Palumbo et al.
2008/0142372 A1 * 6/2008 Laser ..... C25D 3/10 205/290
2008/0193663 A1 8/2008 Strangman et al.
2008/0199722 A1 * 8/2008 Apte ..... C23C 4/02 428/633
2008/0246580 A1 * 10/2008 Braun ..... C25D 1/10 338/20
2008/0272004 A1 11/2008 Roth-Fagaraseanu
2009/0114544 A1 * 5/2009 Rousseau ..... C25D 3/10 205/243
2009/0236227 A1 9/2009 Kuzmanovic et al.
2010/0108524 A1 5/2010 van Mol et al.
2010/0243464 A1 * 9/2010 Gualtieri ..... C23C 10/02 205/181
2010/0261034 A1 10/2010 Cardarelli
2011/0083967 A1 4/2011 Ruan et al.
2012/0031766 A1 2/2012 Inoue
2012/0312692 A1 12/2012 Kimura et al.
2013/0168258 A1 7/2013 Nakano et al.
2013/0302641 A1 11/2013 Zhang et al.
2014/0272458 A1 9/2014 Ruan
2016/0108534 A1 4/2016 Dai

FOREIGN PATENT DOCUMENTS

CN 102041532 A 5/2011
EP 0184985 A2 6/1986
EP 1533401 A1 5/2005
EP 1956118 A2 8/2008
EP 2 330 233 A1 6/2011
EP 2623644 A1 8/2013
GB 503008 * 11/1938
GB WO 2010097577 A1 * 9/2010 ..... C23C 10/10
JP 2004035902 A 2/2004
JP 2004035911 A 2/2004
WO 2006036171 A1 4/2006
WO 2008/127112 A2 10/2008
WO 2009139833 A2 11/2009

OTHER PUBLICATIONS

Vossen et al., Thin Film Processes 245 (1978).*
Knovel Corp., Knovel Critical Tables (2008).*
Bard et al., Electrochemical Dictionary (2008).*
Lou et al., Electroplating (2006).*
EP Search Report, 11 193 119.2, dated May 8, 2012.
N'Gandu-Muamba, J. et al. "The Reactive Element Effect (R.E.E.): A Tentative Classification," Journal De Physique IV, Colloque C9, Supplement au Journal de Physique III, vol. 3, Dec. 1993, pp. 281-290.
Von K. Jopp, L. "Alunniniumabscheidung Mit Ionischen Flussigkeiten, Elegant Deposition of Aluminum from Ionic Liquids," Galvanotechnik, Oct. 2009, pp. 2238-2241.
USPTO Office Action for U.S. Appl. No. 12/970,592; Notification date May 24, 2013.
Lowenheim, F.A.; Electroplating, McGraw-Hill Book Company, New York, 1978, pp. 67-81, 99-112.
EP Search Report for EP 13 152 283.1, dated Jul. 5, 2013.
EP Communication, EP 13152283.1-1359 dated Aug. 14, 2013.
USPTO Office Action for U.S. Appl. No. 12/970,592 dated Oct. 24, 2013.
USPTO Notice of Allowance and Fee(s) Due for U.S. Appl. No. 12/970,592.
EP Examination Report for Application No. 13152283.1, Dated Jun. 26, 2014.
Abbott, A. P., McKenzie K. J., "Application of ionic liquids to the electrodeposition of metals", Physical Chemistry Chemical Physics (http://pubs.rsc.org), 2006, 8, 4265-4279.
Endes, F., "Ionic Liquids: Solvents for the Electrodeposition of Metals and Semiconductors", CHEMPHYSCHEM 2002, 3, 144-154.
EP Communication, EP 11 193 119.2, dated May 29, 2012.
Partial EP Search Report for Application No. 16154946.4-1373 dated Jul. 5, 2016.
Extended EP Search Report for Application No. 16154946A-1373 / 3059335 dated Oct. 24, 2016.
USPTO Office Action for U.S. Appl. No. 14/624,254 dated Mar. 8, 2017.
USPTO Final Office Action for U.S. Appl. No. 14/624,254 dated Jul. 26, 2017.

* cited by examiner

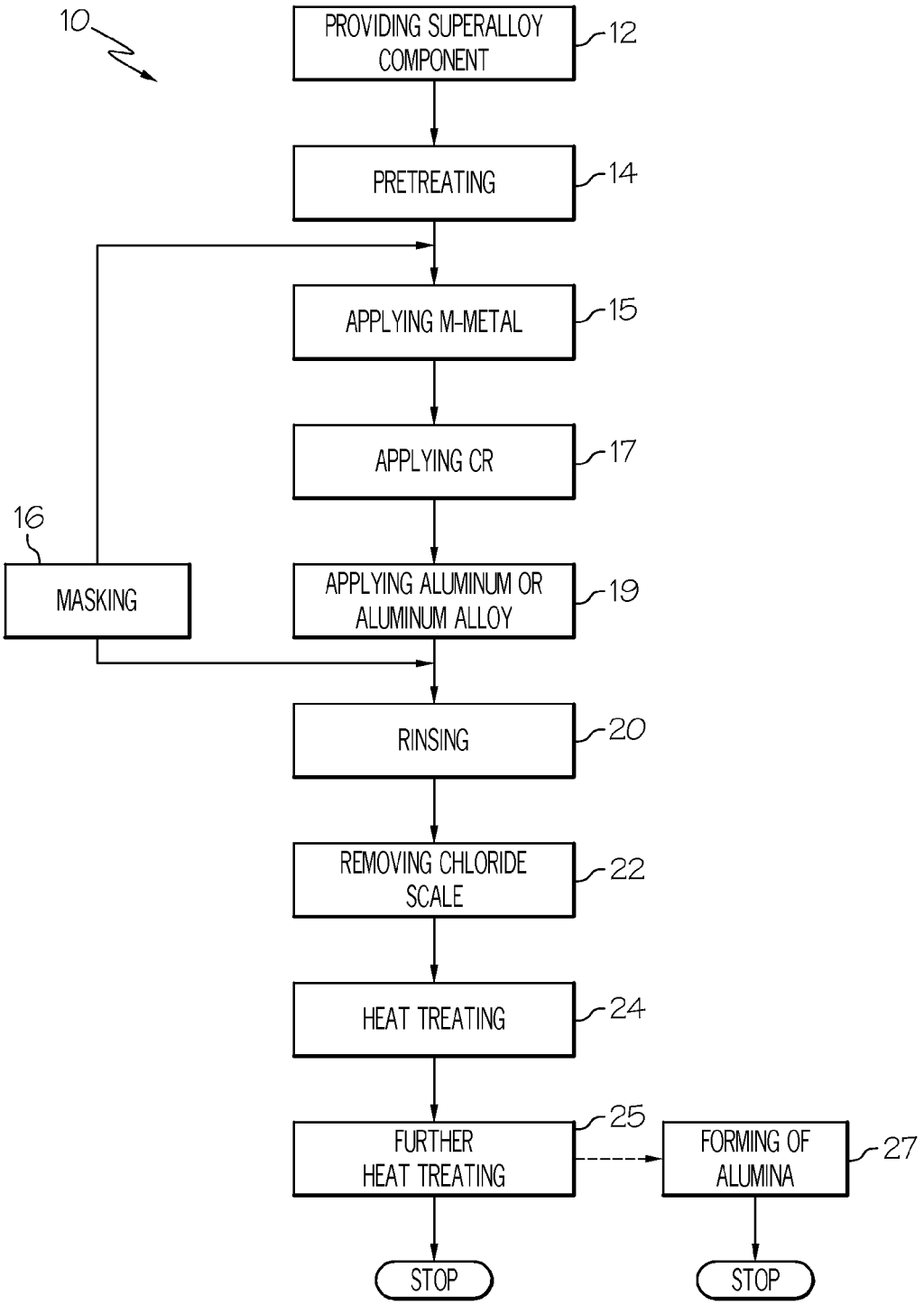
10
PROVIDING SUPERALLOY COMPONENT
12
PRETREATING
14
APPLYING M-METAL
15
APPLYING CR
17
16
MASKING
APPLYING ALUMINUM OR ALUMINUM ALLOY
19
RINSING
20
REMOVING CHLORIDE SCALE
22
HEAT TREATING
24
25
FURTHER HEAT TREATING
FORMING OF ALUMINA
27
STOP
STOP

METHODS FOR PRODUCING A HIGH TEMPERATURE OXIDATION RESISTANT MCRALX COATING ON SUPERALLOY SUBSTRATES

TECHNICAL FIELD

The present invention generally relates to protective coatings for superalloy components that are used at high temperatures, and more particularly relates to methods for producing a high temperature oxidation and hot corrosion resistant MCrAlX coating on superalloy substrates and the coated superalloy substrates thereby produced.

BACKGROUND

Aerospace components made of superalloys, such as nickel and cobalt-based superalloys, are susceptible to oxidation, which can reduce their service life and necessitate their replacement or repair. For example, gas turbine engine components such as the burner assembly, turbine vanes, nozzles, and blades are susceptible to oxidation because they encounter severe, high temperature conditions. As used herein, "severe operating conditions" include high gas velocities and exposure to salt, sulfur, and sand, which can cause hot corrosion or erosion. As further used herein, "high temperature conditions" refers to temperatures of about 700° C. to about 1150° C. The oxidation resistance of such superalloy components can be enhanced by applying protective coatings.

Simple aluminide coatings are used on superalloy components to improve oxidation resistance, especially when the cost of production is a consideration. Platinum aluminide coatings are used in even more demanding applications. There are several drawbacks to conventional aluminum deposition techniques. For example, chemical vapor deposition (CVD) is costly and requires the use of dangerous gases. In another example, the use of pack cementation is less costly, but there are also drawbacks associated with this conventional deposition technique, such as the introduction of impurities into the aluminum, thereby reducing coating life. For both of these gaseous aluminizing processes, the temperatures used are so high that the aluminum diffuses into the superalloy substrate/component as the coating is deposited—the resultant surface aluminide is only about 20-30% aluminum. There are also lower temperature aluminum CVD deposition processes that do not result in aluminum diffusion, but these processes are only used in a few specialized applications, because of the dangerous gases involved.

In addition, as CVD and pack cementation deposition processes are performed at high temperatures and under aggressive deposition conditions, high cost masking techniques prior to deposition are used to ensure that high stress areas of the superalloy component are not coated. After deposition or coating, the masks are removed. High temperature (and high cost) masking techniques include applying masking pastes to the component by spraying or dipping. Extreme care (and labor) must be taken to ensure that only the desired areas are coated. These pastes form hard deposits that are difficult and labor intensive to remove.

Aluminum electroplating processes may also be used to deposit aluminum at high purity levels, but conventional aluminum electroplating is complex, costly, performed at high temperatures, and/or requires the use of flammable solvents and pyrophoric compounds, which decompose, evaporate, and are oxygen-sensitive, necessitating costly specialized equipment and presenting serious safety and environmental challenges to a commercial production facility. In addition, for all aluminum electroplating processes on superalloys, the aluminum is present after plating merely as an aluminum layer on the surface of the substrate. The aluminum layer thereafter needs to be bonded and diffused into the superalloy component to produce the desired high temperature oxidation resistant aluminide coating. As used herein, the term "aluminide coating" refers to the coating after diffusion of aluminum into the superalloy component. If conventional aluminum diffusion temperatures of about 1050° C. to about 1100° C. are used, undesirable microstructures are created. The use of flammable and dangerous liquids during the electroplating of aluminum have been avoided when plating steel etc., that is non-superalloy substrates for non-aerospace applications, by using Ionic liquids. The process includes a first pretreatment step in which the substrate is cleaned and degreased, and in which oxides are removed through acid treatment (commonly referred to as "pickling") or through wet blast abrasion. The substrate is thereafter dried. In the second step, the metal substrate is electroplated using the ionic liquid at a temperature ranging from about 60° C. to about 100° C. In addition the ionic liquids do not involve flammable solvents or pyrophoric compounds.

It is well established that small additions of certain so-called "reactive elements" including silicon, hafnium, zirconium, cerium, and lanthanum increase the oxidation resistance of high temperature aluminide coatings. Unfortunately, the co-deposition of aluminum and a reactive element is difficult, expensive, and can be dangerous. In a best case scenario, the co-deposit requires at least two separate deposition processes, such as the initial deposit of aluminum by a chemical vapor deposition process, pack cementation process, or the like, followed by deposition of the reactive element by another chemical vapor deposition process in the same or a different reactor. In one example, a heat-treated slurry coating containing aluminum and hafnium particles has been used in an attempt to co-deposit aluminum and hafnium to form a protective aluminide-hafnium coating, but the results have been disappointing with the hafnium particles not sufficiently diffusing into the aluminum, the base metal of the coated component oxidizing, and the concentration of the reactive element unable to be controlled.

A particular form of aluminide/reactive element coating that has been well established in the art for use in high temperature coatings is a derivative family of alloys described as "MCrAlXs". MCrAlXs are useful because they exhibit excellent resistance to oxidation and hot corrosion. These alloys, where the "M" represents a metal that may be either iron (Fe), nickel (Ni), or cobalt (Co), or alloys thereof such as iron-base alloys, nickel-base alloys and cobalt-base alloys, and where "X" represents a reactive element that may be Y, Hf, Zr, Si, Ta, Ti, Nb, Mo, W, La, or other reactive element. A common form of MCrAlX coatings are the MCrAlYs, where the "X" reactive element is specified as Yttrium. Further, with the "M" metal specified, these particular coatings are generically referred to as FeCrAlXs, NiCrAlXs, or CoCrAlXs, respectively. MCrAlX coatings are applied to superalloy substrates using expensive techniques, including for example vapor deposition, plasma-based techniques, and high-velocity spraying, among others. Further, some attempts have been made to co-deposit CrAlX powders, particularly CrAlY powders, suspended in aqueous nickel or cobalt electroplating baths, but performance was inferior due to uniformity and impurity issues.

Accordingly, it is desirable to provide methods for producing a high purity, high temperature oxidation and hot corrosion resistant coating on superalloy components, including gas turbine engine components. In addition, it is desirable to provide methods for producing a high temperature oxidation and hot corrosion resistant MCrAlX coating on a superalloy component using a simplified, lower cost, safe, and environmentally-friendly method including the use of low temperature masking techniques. Furthermore, other desirable features and characteristics of the present invention will become apparent from the subsequent detailed description of the invention and the appended claims, taken in conjunction with the accompanying drawings and this background of the invention.

BRIEF SUMMARY

Methods are provided for producing a high temperature oxidation and hot corrosion resistant MCrAlX coating on a superalloy substrate. In accordance with one exemplary embodiment, a method includes applying an M-metal, chromium, and aluminum or an aluminum alloy comprising a reactive element to at least one surface of the superalloy component by electroplating at electroplating conditions below 100° C. in a plating bath thereby forming a plated component and heat treating the plated component.

In accordance with another exemplary embodiment, a method includes applying an M-metal, chromium, and aluminum alloyed with hafnium to at least one surface of the superalloy component by electroplating at electroplating conditions below 100° C. Applying the M-metal comprises applying nickel in a chloride containing, aqueous nickel bath. Applying chromium comprises applying chromic acid in an aqueous bath. Further, applying aluminum alloyed with hafnium comprises applying $AlCl_3$ and $HfCl_4$ in an ionic liquid bath. The method further includes heat treating the plated component.

In accordance with yet another exemplary embodiment, a method includes applying an M-metal, chromium, and aluminum alloyed with hafnium to at least one surface of the superalloy component by electroplating at electroplating conditions below 100° C. Applying the M-metal comprises applying nickel in a chloride containing, aqueous nickel bath in an aqueous bath in a first step. Applying chromium comprises applying chromic acid in an aqueous bath in a second step performed after the first step. Further, applying aluminum alloyed with hafnium comprises applying $AlCl_3$ and $HfCl_4$ in an ionic liquid bath in a third step performed after the second step. The method further includes heat treating the plated component at a first temperature for a first period of time and at a second temperature for a second period of time, wherein heat-treating the plated component at a first temperature for a first period of time comprises heat-treating the plated component at a temperature of about 600° C. to about 650° C. for about 15 minutes to about 45 minutes and wherein heat-treating the plated component at a second temperature for a second period of time comprises heat-treating the plated component at a temperature of about 700° C. to about 1050° C. for about one half of one hour to about two hours.

BRIEF DESCRIPTION OF THE DRAWINGS

The present invention will hereinafter be described in conjunction with the following drawing figures, wherein like numerals denote like elements, and wherein:

FIG. 1 is a flow diagram of methods for producing a high temperature oxidation and hot corrosion resistant MCrAlX coating on superalloy substrates, according to exemplary embodiments of the present invention.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention, which is defined by the claims. Furthermore, there is no intention to be bound by any expressed or implied theory presented in the preceding technical field, background, brief summary, or the following detailed description.

Various embodiments are directed to methods for producing a high purity, high temperature oxidation and hot corrosion resistant MCrAlX coating on superalloy components by: (1) applying an "M" metal or alloy to at least one surface of the superalloy at a heating temperature at or below 100° C. in an aqueous or ionic liquid M-metal plating bath including an M-metal compound; applying chromium to the at least on surface of the super alloy at a heating temperature at or below 100° C. in an aqueous or ionic bath including an aqueous or ionic liquid and an chromium compound; and (3) applying aluminum or an aluminum alloy to the at least one surface of the superalloy substrate at a heating temperature at or below 100° C. in ionic liquid aluminum plating bath including an ionic liquid and an aluminum compound. The ionic liquid aluminum plating bath may further include a dry salt or other compound of a reactive element to co-deposit aluminum and the reactive element "X" (the "aluminum alloy") in a single step and further improve the oxidation resistance of the coating at high temperatures, i.e., temperatures from about 700 to about 1150° C., to extend the life of the superalloy component. The coating may include one layer or multiple layers formed in any sequence. The aqueous or ionic baths referred to above may include one or more of the M-metal compound, the chromium compound, the aluminum compound, and the reactive element compound. Additionally, a thermal barrier coating may be used with and/or added to the high temperature oxidation resistant coating.

As used herein, the term "ionic liquid" refers to salts that are liquid at low temperatures (typically below 100° C.) due to their chemical structure, comprised of mostly voluminous, organic cations and a wide range of ions. They do not contain any other non-ionic components like organic solvent or water. Ionic liquids are not flammable or pyrophoric and have low or no vapor pressure, and therefore do not evaporate or cause emissions.

Referring to FIG. 1, a method 10 for producing a high temperature oxidation resistant MCrAlX coating on a superalloy component begins by providing the superalloy component 30 (step 12). The superalloy component includes a component that is comprised of a cobalt-based superalloy, a nickel-based superalloy, or a combination thereof. As used herein, the superalloy is the base metal. Suitable exemplary superalloys include, for example, Mar-M247 and SC180. The surface portions of the superalloy component to be coated are activated by pre-treating to remove any oxide scale on the base metal (step 14). The oxide scale may be removed by, for example, wet blasting with abrasive particles, chemical treatment such as detergents, ultrasonics, or by other methods as known in the art.

Certain surface portions of the superalloy component are not coated and therefore, these surface portions may be covered (masked) prior to electroplating the superalloy component as hereinafter described and as known in the art. Alternatively or additionally, surface portions where the coating is to be retained may be masked after electroplating followed by etching away the unmasked coating with a selective etchant that will not etch the base metal. Suitable exemplary mask materials include glass or Teflon® non-stick coatings. Suitable exemplary etchants include, for example, KOH, NaOH, LiOH, dilute HCl, $H_2SO_4$, H2SO4/H3PO4, commercial etchants containing $H_3PO_4$, $HNO_3$/acetic acid, or the like. The masking step, whether performed prior to, after, or both prior and after electroplating is referred to as step 16. When the masking step is performed prior to electroplating, the mask material used is compatible with ionic liquids. As the electroplating is performed at relatively low temperatures (less than about 100° C.), low temperature masking techniques may be used. Plastic masking materials such as, for example, a Teflon® non-stick mask are suitable and can be quickly placed on the areas not to be coated either as tape wrapped or as a perform which acts as a glove. Such masks may be relatively quickly applied and quickly removed and can be reused, making such low temperature masking techniques much less expensive and time consuming than conventional high temperature masking techniques.

Still referring to FIG. 1, method 10 further includes applying an M-metal (Fe, Co, Ni), or an M-metal alloy, to the activated surface(s) of the superalloy component by electroplating the superalloy component (masked or unmasked) in an aqueous or ionic liquid M-metal plating bath to form a plated superalloy component (step 15). The aqueous or ionic liquid M-metal plating bath includes an M-metal compound, for example an M-metal salt, dissolved in an aqueous or ionic liquid. The amount of each compound in the aqueous or ionic liquid should be such that the bath is liquid at room temperature and that it forms a good deposit as determined, for example, by scanning electron microscopy (SEM). In one exemplary embodiment, the bath is an aqueous bath, and the M-metal compound is a chloride salt of the M-metal. In a further exemplary embodiment, the bath is an aqueous bath, and the M-metal compound is dissolved nickel chloride.

Method 10 further includes applying chromium, or a chromium alloy, to the activated surface(s) of the superalloy component by electroplating the superalloy component (masked or unmasked) in an aqueous or ionic liquid chromium plating bath to form a plated superalloy component (step 17). The aqueous or ionic liquid chromium plating bath includes a chromium compound, for example chromium salt or a chromium acid, dissolved in, suspended in, diluted in, or otherwise dispersed in an aqueous or ionic liquid. The amount of each compound in the aqueous or ionic liquid should be such that the bath is liquid at room temperature and that it forms a good deposit as determined, for example, by SEM micrograph. In one exemplary embodiment, the bath is an aqueous bath, and the chromium compound is a chromium acid.

After the M-metal and the Cr have been plated on the superalloy substrate, they may require a low temperature diffusion heat treatment to fully bond them to the substrate. This may be necessary after each plating operation or just prior to the aluminum ionic plating. The low temperature diffusion may be carried out at a temperature from about 550° C. to about 750° C. for a time period from about 15 minutes to about 45 minutes. The operation may be carried out in air or in a protective atmosphere or vacuum to avoid oxidation.

Still referring to FIG. 1, method 10 further includes applying aluminum, or an aluminum alloy to the activated surface(s) of the superalloy component by electroplating the superalloy component (masked or unmasked) in an ionic liquid aluminum plating bath to form a plated superalloy component (step 19). The ionic liquid aluminum plating bath includes an aluminum salt or other aluminum compound dissolved in an ionic liquid. As noted previously, the ionic liquid aluminum plating bath may further comprise a dry salt of a reactive element or other compound of a reactive element if the aluminum alloy is to be applied, as hereinafter described. Both salts/compounds (aluminum and reactive element) are electrochemically deposited from the bath as an alloy in one or more process steps. The amount of each salt/compound in the bath should be such that the bath is liquid at room temperature and that it forms a good deposit as determined, for example, by SEM micrograph. An exemplary aluminum salt dissolved in an ionic liquid includes, for example, Aluminum chloride ($AlCl_3$). Possible suitable anions other than chloride anions that are soluble in the ionic liquid aluminum plating bath and can be used in the aluminum salt include, for example, acetate, hexafluorophosphate, and tetrafluoroborate anions as determined by the quality of the deposit. Suitable exemplary ionic liquids are commercially available from, for example, BASF Corporation, Rhineland-Palatinate, Germany and include 1-ethyl-3-methylimidazolium chloride (also known as EMIM Cl), 1-ethyl-3-methylimidazolium bis(trifluoromethyl-sulfonyl)amide (also known as [EMIM] $Tf_2N$), 1-butyl-1-1-methylpyrrolidinium bis(trifluoromethyl sulfonyl)amide (also known as [BMP] $Tf_2N$), 1-butyl-1-methyl-pyrrolidinium bis(trifluoromethylsulfonyl)amide (also known as [Py(1,4)]Tf(2)N), and combinations thereof. An exemplary ionic liquid aluminum plating bath comprising 1-ethyl-3-methylimidazolium chloride (EMIM Cl) and $AlCl_3$ is available commercially from BASF Corporation, and marketed under the trade name BASF Basionics™ Al03. Other suitable ionic liquid aluminum plating baths may be commercially available or prepared using separately available ionic liquids and aluminum salts. For example, an ionic liquid aluminum plating bath of EMIM-Cl and $AlCl_3$ in a molar ratio of 1.0 to 1.5 has the following weight percentages of ionic liquid (EMIM Cl) and aluminum salt ($AlCl_3$): 42.3 wt % EMIM Cl and 57.7 wt % $AlCl_3$. The weight percentage of $AlCl_3$ in EMIM-Cl ionic liquid may vary +/−25%, i.e., 43 to 72 wt % in the above example.

As noted previously, in an embodiment, the ionic liquid aluminum plating bath may further include a dry salt or other compound of a "reactive element". "Reactive elements" include silicon (Si), hafnium (Hf), zirconium (Zr), cesium (Cs), lanthanum (La), yttrium (Y), tantalum (Ta), titanium (Ti), rhenium (Re), or combinations thereof. Exemplary dry salts of the reactive element include dry hafnium salts, for example, anhydrous hafnium chloride ($HfCl_4$), dry silicon salts, for example, anhydrous silicon chloride, dry zirconium salts, for example, anhydrous Zirconium (IV) chloride ($ZrCl_4$), dry cesium salts, dry lanthanum salts, dry yttrium salts, dry tantalum salts, dry titanium salts, dry rhenium salts, or combinations thereof "Dry salts" are substantially liquid/moisture-free. The salt of the reactive element is preferably in a +4 valence state because of its solubility in the ionic liquid aluminum plating bath, however other valance states may be used if the desired solubility is present. While chloride salts have been described, it is to be understood that other reactive element salts may be used such as, for example, reactive element salts of acetate, hexafluorophosphate, and tetrafluoroborate anions. The anion of the reactive element salt may be different or the same as the anion of the aluminum salt. Reactive elements have the potential to spontaneously combust and react with water. By alloying the reactive element salt with aluminum in the ionic liquid aluminum plating bath in a single electroplating step in accordance with exemplary embodiments, the reactivity of the reactive element and their susceptibility to oxidation is decreased, thereby making deposition simpler and safer than conventional two step deposition processes. The concentration of reactive element in the deposit comprises about 0.05 wt % to about 10 wt % (i.e., the ratio of reactive element to aluminum throughout the deposit, no matter the number of layers, desirably remains constant). In an ionic liquid aluminum plating bath, the concentration of hafnium chloride may include about 0.001 wt % to about 5 wt %, preferably about 0.0025 to about 0.100 wt %. This preferred range is for a single layer. Multiple layers with thin hafnium concentrated layers would require higher bath concentrations of $HfCl_4$. A similar concentration range of reactive element salts other than hafnium chloride in the ionic liquid aluminum plating bath may be used.

The steps of applying an M-metal or an M-metal alloy, applying chromium or a chromium alloy, and applying aluminum or an aluminum alloy are performed at electroplating conditions as hereinafter described, and may be performed in ambient air (i.e., in the presence of oxygen). It is preferred that the electroplating be performed in a substantially moisture-free environment where an ionic bath is used. For example, and as will be appreciated by those having ordinary skill in the art, an ionic liquid aluminum plating bath remains stable up to a water content of 0.1 percent by weight. At higher water content, electrodeposition of aluminum ceases, chloroaluminates are formed, water electrolyzes into hydrogen and oxygen, and the bath forms undesirable compounds and vapors. Other ionic bath embodiments will be expected to experience similar problems at higher water content.

Where ionic baths are used, a commercial electroplating tank or other vessel equipped with a cover and a purge gas supply as known in the art may be used to form positive pressure to substantially prevent the moisture from the air getting into the ionic liquid plating bath. Suitable exemplary purge gas may be nitrogen or other inert gas, dry air, or the like. The metal layer is formed on the superalloy component (s) using the ionic liquid plating bath with one or more metal anodes and the superalloy component(s) to be coated (i.e., plated) as cathode. Suitable electroplating conditions are known to one skilled in the art and vary depending on the desired thickness of the electroplated layer(s) or coating. Depending on which layer of the MCrAlX coating is being plated, the total thickness of the layer is about 5 to about 50 microns. For example, the thickness of the M-metal or M-metal alloy layer may be about 30 microns to about 50 microns. The thickness of the chromium or chromium alloy layer may be about 5 microns to about 20 microns. The aluminum or aluminum alloy layer may be about 5 microns to about 10 microns. As such, the overall thickness of the MCrAlX coating is about 40 microns to about 80 microns. Suitable electroplating temperatures range between about 70° to about 100° C., preferably about 90° C. to about 95° C. with a potential of about 0.05 volts to about 1.50 volts.

Elemental precious metals such as, for example, platinum may also be included in the liquid aluminum plating bath to form, respectively, a platinum-aluminum layer or a platinum-aluminum alloy layer. Alternatively or additionally, a platinum layer may be applied to the surface of the superalloy component prior to applying the aluminum or aluminum alloy to at least one surface of the superalloy component and the all layers thermally diffused into the superalloy component in another operation to form a platinum aluminide coating, as hereinafter described. Alternatively, an initial platinum layer may be diffused into the superalloy component prior to electroplating of the aluminum or aluminum alloy. A platinum layer may also or alternatively be used over the aluminum or aluminum alloy. The presence of platinum in the coating, either as a separate layer or alloyed with aluminum (with and without a reactive element) increases the high temperature oxidation resistance of the coating over a coating not containing platinum.

Aqueous baths, due to the fact that the metal compounds are dissolved in water, do not require the same protections and equipment as described above with regard to ionic liquid baths. Rather, in an aqueous liquid bath, the superalloy may simply be placed in the aqueous liquid at ambient conditions, with electrical potential applied in the manner described above.

It will be appreciated that the electroplating steps described above may be implemented as one, two, three, or more steps. In an exemplary three-step embodiment, the M-metal layer is first electrodeposited, followed by a chromium layer, and finally a aluminum/reactive element layer. In an exemplary two-step embodiment, chromium is co-deposited with the aluminum and reactive elements, subsequent to the depositing of the M-metal layer. In an exemplary one-step embodiment, all of the M-metal, chromium, aluminum and reactive elements are co-deposited.

After removal of the plated superalloy component from the ionic liquid one or more plating baths, the plated superalloy component is rinsed with a solvent such as acetone, alcohol, or a combination thereof (step 20). This step may be performed after each bath where multiple baths are used, as indicated in FIG. 1. As ionic liquids are water-reactive as described previously, it is preferred that where ionic liquids are used, the plated superalloy component be rinsed with at least one acetone rinse to substantially remove the water-reactive species in the ionic liquid before rinsing the plated superalloy component with at least one water rinse. The plated superalloy component may then be dried, for example, by blow drying or the like.

In embodiments where chloride salts are employed, it will be appreciated that it is difficult to remove all the chlorides during a rinsing step, and while not wishing to be bound by any particular theory, it is believed that residual chloride may remain on the surface of the plated superalloy component trapped under aluminum oxide (alumina or $Al_2O_3$) scale formed on the surface of the plated superalloy component. Performance of the coated superalloy component may suffer if the scale and residual chloride (hereinafter collectively referred to as "chloride scale") are not substantially removed. Referring again to FIG. 1, in accordance with an exemplary alternative embodiment, method 10 may include an optional step of substantially removing the chloride scale from the surface of the plated superalloy component (step 22). The chloride scale may be removed by an alkaline rinse, an acid rinse using, for example, mineral acids such as HCl, $H_2SO_4$, or organic acids such as citric or acetic acid, or by an abrasive wet rinse because the plating is non-porous. The alkaline rinse may be an alkaline cleaner, or a caustic such as sodium hydroxide, potassium hydroxide, or the like. A desired pH of the alkaline rinse is from about 10 to about 14. The abrasive wet rinse comprises a water jet containing abrasive particles. Both the alkaline rinse and the abrasive wet rinse etch away the chloride scale and a very thin layer of the plating without etching the base metal of the superalloy component. For example, about 0.1 microns of the plating may be etched away. After removal of the chloride scale, the plated superalloy component may be rinsed with at least one water rinse and then dried, for example, by blow drying or the like or using a solvent dip such as, for example, 2-propanol or ethanol to dry more rapidly.

Method 10 further includes heat treating the plated superalloy component in a first heating step at a first temperature less than about 1050° C., preferably about 600° C. to about 650° C. and held for about 15 to about 45 minutes (step 24) and then further heating at a second temperature of about 700° C. to 1050° C. for about 0.50 hours to about two hours (step 25). The second heating step causes diffusion of the aluminum or aluminum alloy into the superalloy component. Heat treatment may be performed in any conventional manner. At the relatively low temperatures of the first and second heating steps, the coating materials do not diffuse as deeply into the superalloy component as with conventional diffusion temperatures, thereby reducing embrittlement of the superalloy component. Thus, the mechanical properties of the coating are improved. However, at such temperatures, alpha alumina, which increases the oxidation resistance of the base metal as compared to other types of aluminas, may not be formed as the surface oxide. Therefore, an optional third heat treatment at about 1000° C. to about 1050° C. for about 5 to about 45 minutes may be desired in order to substantially ensure formation of an alpha alumina oxide layer in the coating. The third heat treatment may be performed, for example, in a separate furnace operation. Alternatively, other techniques to form the alpha alumina surface layer after the first and second heat treatments may be used including, for example, formation of high purity alpha alumina by, for example, a CVD process or a sol gel type process as known in the art.

In accordance with another exemplary embodiment, the plated superalloy component is heat treated in the first heating step followed by further heating at a second temperature of about 750° C. to about 900° C. and holding for a longer residence time of about 12 to about 20 hours to diffuse aluminum into the superalloy component forming the alpha alumina (or alpha alumina alloy) surface layer (step 27). Costs are reduced by avoiding additional heating in a separate furnace operation or using other techniques to form the alpha alumina surface layer. In addition, a separate aging step as known in the art is rendered unnecessary.

After the heat treatment the average composition of the MCrAlX coating can have a composition within the following range: Ni remainder; Co from about 0% to about 25%; Cr from about 5% to about 30%; Al from about 5% to about 25%; Pt from about 0% to about 20%; and X from about 0% to about 2%. The reactive element X is preferably Hf, Y, or Zr. X may also be a combination of the reactive elements for example, about 1% Hf and about 1% Si; or about 0.5% Hf, about 0.5% Zr, about 0.5% Y, and about 0.5% Si.

The coating may be applied as layers of Ni, Cr, and Al which are then diffused. This can be used to vary the coating chemistry, with composition of the elements varying across the coating, for instance increasing the amount of Cr and/or Al, or other protective elements, on a relative basis at the surface of the coating (as compared to areas deeper within the coating) to improve hot corrosion resistance. The preferred plating order is Ni/Cr/AlHf, but it is possible to change this order and to also plate the same element more than once, for instance Cr/Ni/Pt/Ni/AlHf or Cr/Pt/AlHf/Ni. Other variants are possible that may facilitate the plating operations or produce properties required for specific applications.

The high purity, high temperature oxidation and hot corrosion resistant MCrAlX coatings produced in accordance with exemplary embodiments may be comprised of one or more layers, formed in any sequence, and having varying concentrations of reactive elements, if any. As used herein, "high purity" means having a purity greater than about 99.5%.

The high temperature oxidation resistant coating of the present invention may be used with a thermal barrier coating (TBC). For example, the high temperature oxidation resistant coating may be used as an intermediate coat between the superalloy component and the thermal barrier coating. There may also be additional intermediate coats between the superalloy component and the thermal barrier coating. The oxidation resistant coating may be used on new and repaired and overhauled turbine engine components.

EXAMPLES

The following examples were prepared according to the steps described above. The examples are provided for illustration purposes only, and are not meant to limit the various embodiments of the present invention in any way. The coatings produced in accordance with these examples were analyzed by scanning electron micrography (SEM).

Example 1

A 1 inch×1 inch square of a Mar-M247 activated substrate (having been previously detergent-cleaned and wet-blasted with 200 mesh quartz abrasive, and activated with Woods Nickel Strike™) was electroplated in a three-step process. In step 1, the substrate was immersed in an aqueous chloride nickel bath and electroplated to a minimum thickness of 45 microns nickel. The substrate was then re-activated. In step 2, the substrate was immersed in an aqueous chromic acid bath and electroplated to a minimum thickness of 6 microns chromium. The substrate was then re-activated. In step 3, the substrate was immersed in an ionic liquid aluminum plating bath of 400 grams BASF AL03 and 0.50 grams of anhydrous $HfCl_4$, to a minimum thickness of 7 microns (the resulting alloy being about 90% Al and about 10% Hf). The total coating thickness achieved was 58 microns. The aforesaid electroplating conditions included the following:

Current density=13.1 amps/ft$^2$ (ASF)

Time=15-75 minutes, depending on thickness desired

Temperature=90.0 to 90.6° C.

Potential=1.05 volts

The electroplated sample was rinsed, the chloride scale removed, and then was heat treated at 625° C. for 15 minutes followed by further heat treating at 750° C. for one hour. The coated substrate was analyzed by SEM micrograph, showing a uniform surface appearance. The approximate desired composition of the resultant NiCrAlHf coating prepared in this example is shown below in Table 1:

TABLE 1

| Elements: | WT % |
|---|---|
| Nickel | 79 |
| Chromium | 10 |
| Aluminum | 10 |
| Hafnium | 1 |

Example 2

A 1 inch×1 inch square of a Mar-M247 activated substrate (having been previously detergent-cleaned and wet-blasted with 200 mesh quartz abrasive, and activated with Woods Nickel Strike™) was electroplated in a three-step process. In step 1, the substrate was immersed in an aqueous chloride nickel bath and electroplated to a minimum thickness of 40 microns nickel. The substrate was then re-activated. In step 2, the substrate was immersed in an aqueous chromic acid bath and electroplated to a minimum thickness of 11 microns chromium. The substrate was then re-activated. In step 3, the substrate was immersed in an ionic liquid aluminum plating bath of 400 grams BASF AL03 and 0.50 grams $HfCl_4$, to a minimum thickness of 7 microns (the resulting alloy being about 90% Al and about 10% Hf). The total coating thickness achieved was 58 microns. The aforesaid electroplating conditions included the following:

Current density=13.1 amps/$ft^2$ (ASF)

Time=15-75 minutes, depending on thickness desired

Temperature=90.0 to 90.6° C.

Potential=1.05 volts

The electroplated sample was rinsed, the chloride scale removed, and then was heat treated at 625° C. for 15 minutes followed by further heat treating at 750° C. for one hour. The coated substrate was analyzed by SEM micrograph, showing a uniform surface appearance. The approximate desired composition of the resultant NiCrAlHf coating prepared in this example is shown below in Table 2:

TABLE 2

| Elements: | WT % |
|---|---|
| Nickel | 69 |
| Chromium | 20 |
| Aluminum | 10 |
| Hafnium | 1 |

Example 3

A 1 inch×1 inch square of a Mar-M247 activated substrate (having been previously detergent-cleaned and wet-blasted with 200 mesh quartz abrasive, and activated with Woods Nickel Strike™) was electroplated in a three-step process. In step 1, the substrate was immersed in an aqueous chloride nickel bath and electroplated to a minimum thickness of 33 microns nickel. The substrate was then re-activated. In step 2, the substrate was immersed in an aqueous chromic acid bath and electroplated to a minimum thickness of 18 microns chromium. The substrate was then re-activated. In step 3, the substrate was immersed in an ionic liquid aluminum plating bath of 400 grams BASF AL03 and 0.50 grams of anhydrous $HfCl_4$, to a minimum thickness of 7 microns (the resulting alloy being about 90% Al and about 10% Hf). The total coating thickness achieved was 58 microns. The aforesaid electroplating conditions included the following:

Current density=13.1 amps/$ft^2$ (ASF)

Time=15-75 minutes, depending on thickness desired

Temperature=90.0 to 90.6° C.

Potential=1.05 volts

The electroplated sample was rinsed, the chloride scale removed, and then was heat treated at 625° C. for 15 minutes followed by further heat treating at 750° C. for one hour. The coated substrate was analyzed by SEM micrograph, showing a uniform surface appearance. The approximate desired composition of the resultant NiCrAlHf coating prepared in this example is shown below in Table 3:

TABLE 3

| Elements: | WT % |
|---|---|
| Nickel | 59 |
| Chromium | 30 |
| Aluminum | 10 |
| Hafnium | 1 |

From the foregoing, it is to be appreciated that the methods for producing a high purity, dense high temperature oxidation and hot corrosion resistant coating on a superalloy substrate are simplified, low cost, and environmentally friendly. The various possible MCrAlX components are able to be applied in a single deposition step or in a multi-step deposition process, and low temperature masking techniques can be used. The coating extends the life of the coated superalloy component produced from such methods.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for producing a high temperature oxidation and hot corrosion resistant MCrAlX coating on a superalloy component, the method comprising:

applying an M-metal selected from the group consisting of: iron, nickel, and cobalt;

chromium; and an aluminum alloy comprising a reactive element X selected from the group consisting of: Y, Hf, Zr, Si, Ta, Ti, Nb, Mo, W, and La, to at least one surface of the superalloy component by electroplating at electroplating conditions below 100° C. in a plating bath thereby forming a plated component; and heat treating the plated component, wherein applying the M-metal, chromium, and aluminum alloy comprising the reactive element X is performed in a three-step process comprising a first step of applying the M-metal in a one-step process using a single aqueous or ionic liquid bath to form a single M-metal layer over and in physical contact with the substrate, a second step of applying the chromium in a one-step process using a single aqueous or ionic liquid bath over the single M-metal layer, thereby forming a single chromium layer over and in physical contact with the single M-metal layer, and a third step of applying the aluminum alloy comprising the reactive element X in a one-step process using a single ionic liquid bath over the single chromium layer, thereby forming a single aluminum/reactive element X layer over and in physical contact with the single chromium layer, wherein the reactive element comprises about 0.001% to about 5 wt % of the single ionic liquid bath, wherein the second step is performed after completing the first step, wherein the third step is performed after completing the second step, and wherein a low-temperature diffusion step is performed after the second step but before the third step, the low-temperature diffusion step comprising heating the superalloy component to a temperature of from about 550° C. to about 750° C.

2. The method of claim 1, wherein applying the M-metal comprises applying nickel metal by electro-deposition in an aqueous, chloride containing bath.

3. The method of claim 1, wherein applying chromium comprises chromic acid in an aqueous bath.

4. The method of claim 1, wherein applying aluminum alloyed with the reactive element comprises applying aluminum alloyed with hafnium.

5. The method of claim 1, wherein applying the aluminum alloy comprising the reactive element comprises applying an aluminum alloy comprising a reactive element, wherein the reactive element comprises about 0.05% to about 10 wt % of the high temperature oxidation resistant coating.

6. The method of claim 1, further comprising the step of forming an alpha alumina oxide layer on the surface of the plated component.

7. The method of claim 1, wherein heat treating the plated component comprises heat-treating the plated component at a first temperature for a first period of time and at a second temperature for a second period of time.

8. The method of claim 1, wherein heat-treating the plated component at a first temperature for a first period of time comprises heat-treating the plated component at a temperature of about 600° C. to about 650° C. for about 15 minutes to about 45 minutes, and wherein heat-treating the plated component at a second temperature for a second period of time comprises heat-treating the plated component at a temperature of about 700° C. to about 1050° C. for about one half of one hour to about two hours.

9. The method of claim 1, wherein producing a high temperature oxidation and hot corrosion resistant MCrAlX coating comprises producing a coating having a composition within the following range: Ni remainder; Co from about 0% to about 25%; Cr from about 5% to about 30%; Al from about 5% to about 25%; Pt from about 0% to about 20%; and X from about 0% to about 2%, and wherein X is Hf, Y, Si, or Zr or mixtures thereof.

10. The method of claim 1, further comprising forming a thermal barrier coating over the plated component.

* * * * *